United States Patent [19]

Dodge

[11] Patent Number: 4,839,973

[45] Date of Patent: Jun. 20, 1989

[54] SKI BOOT

[75] Inventor: David J. Dodge, Shelburne, Vt.

[73] Assignee: Lange International S.A., Switzerland

[21] Appl. No.: 36,268

[22] Filed: Apr. 9, 1987

[51] Int. Cl.[4] ..... A43B 5/04

[52] U.S. Cl. ..... 36/121; 36/119

[58] Field of Search ..... 36/117–121, 36/93, 71, 105, 87

[56] References Cited

U.S. PATENT DOCUMENTS

| | | | |
|---|---|---|---|
| 3,538,627 | 11/1970 | Larat-Camy | 36/120 |
| 3,939,582 | 2/1976 | Garbuio | 36/117 |
| 4,078,322 | 3/1978 | Dalebout | 36/121 |
| 4,428,130 | 1/1984 | Perotto | 36/117 |
| 4,570,364 | 2/1986 | Walkhoff | 36/121 |
| 4,615,127 | 10/1986 | Delert | 36/117 |
| 4,654,985 | 4/1987 | Chalmers | 36/117 X |
| 4,669,202 | 6/1987 | Ottieri | 36/120 |
| 4,759,137 | 7/1988 | Lederer | 36/117 |

FOREIGN PATENT DOCUMENTS

| | | | |
|---|---|---|---|
| 2323417 | 11/1974 | Fed. Rep. of Germany | 36/93 |
| 2514207 | 10/1976 | Fed. Rep. of Germany | 36/117 |
| 3530243 | 3/1987 | Fed. Rep. of Germany | 36/117 |
| 2556187 | 6/1985 | France | 36/117 |

*Primary Examiner*—James Kee Chi

*Attorney, Agent, or Firm*—Kane, Dalsimer, Sullivan, Kurucz, Levy, Eisele and Richard

[57] ABSTRACT

A ski boot has a lower part and an upper articulated on the lower part at two opposite points which coincide with the joint of the foot. The rear part of the upper has a rounded cutaway portion which permits ample backward tilting. This cutaway portion is preferably covered by an articulated stirrup-shaped shroud connected to the upper by a rigid linking member.

12 Claims, 4 Drawing Sheets

SKI BOOT

FIELD OF THE INVENTION

The present invention relates to a ski boot consisting of a lower part, comprising the sole and the vamp and surrounding the heel, and a one- or two-part upper articulated on the lower part at two opposite points which coincide at least approximately with the joint of the user's foot.

PRIOR ART

Depending on their method of putting on, essentially two types of boots having a shell of synthetic material are distinguished. The boots of the first type, known as front entry boots, comprise a single piece upper which closes at the front, as described, for example, in patent No. CH 549,970. The boots of the second type, known as rear entry boots, comprise an upper composed of a front part and of a rear part which fits into the front part to surround the skier's foot and can be swung back for the purpose of putting on, as described, for example, in patent No. FR 2,428,413.

In boots of the first type, as is clearly seen in FIG. 2 of patent No. CH 549,970, backward tilting of the upper about the axis of articulation passing through the malleoli is not possible, since the upper immediately abuts against the rear of the lower shell. To permit slight backward tilting, it would be necessary to leave a space between the upper and the lower shell, and this space would allow snow to enter the shell. Such a space is hence unacceptable, and it is necessary, on the contrary, if possible, to ensure continuous contact between the upper and the lower shell.

In boots of the second type, having rear entry, the rear part of the shell can tilt back, since its axis of articulation, coincident with the axis of articulation of the upper, is situated below the joint of the skier's foot. Such an articulation of the upper is nevertheless insufficient during skiing, since it does not correspond to the natural articulation of the foot and gives rise to pressure on the heel during forward bending. The disparity between the articulation of the upper of the boot and the joint of the skier's foot produces, in addition, when the leg bends, a linear contact area about the point of tibial support of the leg.

It has already been proposed to obviate these defects by articulating the rear part of the upper on its front part and not on the lower shell, and by articulating the front part on the shell about a second articulation which coincides with the joint of the skier's foot. In the closed position, the boot is then equivalent to a boot of the first type, with the same disadvantage, that is to say the impossibility of tilting back, with the result that, even when released, the upper does not permit normal walking, with or without skis. It has been proposed, in addition, to obviate the defect concerning the point of tibial support in a rear entry boot by mounting an articulated pressure-distribution plate in the top front part of the upper (FR-A-2,506,135).

The objective of the invention is to enable the upper of the boot not only to straighten up in the free position, but also to tilt backwards through a relatively large angle, while being articulated about an axis which coincides with the joint of the skier's foot.

This has two advantages: the first, for a boot of the first type, to facilitate putting on by swinging the one-piece upper backwards to the maximum, with the result that the front entry boot almost becoms a rear entry boot; and the second, to facilitate walking by means of both types of boot, in particular when descending, by enabling the upper to follow the natural pivoting of the foot.

SUMMARY OF THE INVENTION

According to one embodiment, the region uncovered by the cutaway portion is covered by a stirrup-shaped shroud which is articulated on the lower part of the boot at two opposite points situated below the points of articulation of the upper, with the result that this shroud can tilt backwards, the rear part of the upper and the tilting shroud being connected to one another by a rigid linking member which extends in a vertical plane and whose ends are articulated, respectively, on the upper and on the tilting shroud.

There is, in addition, no obstacle to providing means for locking the shroud of the type described in patent No. EP 0,086,908, for locking the shroud to the boot in the forward position of the upper, and to providing a linking member of adjustable length which enables the rake of the upper to be adjusted.

The tilting shroud can, in addition, advantageously be used for attaching the end of draw cords designed for clamping the front part of the boot.

BRIEF DESCRIPTION OF THE DRAWINGS

The attached drawings show, by way of example, an embodiment of the invention.

DESCRIPTION OF THE PREFERRED EMBODIMENT(S)

Figure 1:
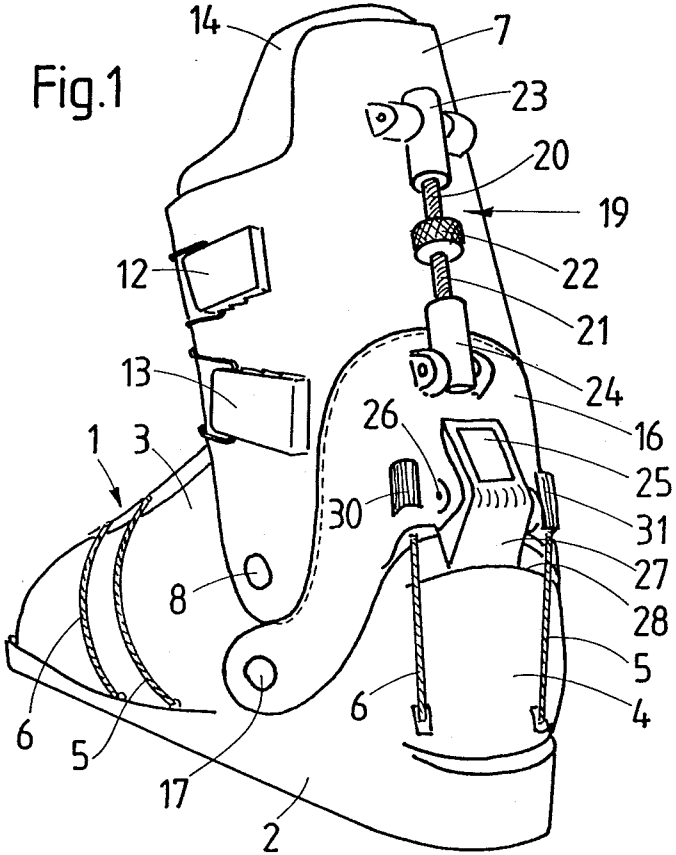
FIG. 1 is a perspective view of the boot in the closed position and tilting shroud locked.

The boot shown in the drawing is made of semirigid moulded synthetic material. It consists of a lower part 1, comprising the sole 2, the vamp 3 and a rear part surrounding the heel and extended above the heel in a form of a half-upper, which is more readily visible in FIG. 3. The vamp 3 has two superposed lugs which enable the foot to be clamped by means of two draw cords 5 and 6. On this lower part 1, an upper 7 is articulated about two opposite rivets 8 and 9 (FIG. 3), situated in such a way that they are facing the natural joint of the foot, that is to say the malleolus. In the embodiment in question, the upper 7 is made in a single part, but it could also consist of two parts, namely a front part and a rear part. The upper 7 is closed at the front by means of a flap and two buckles 10 and 11 which hook over tensioning levers 12 and 13. The boot incorporates, in addition, an inner boot 14, shown only in FIG. 1. At its lower rear edge, the upper 7 has a wide, rounded cutaway portion 15, which extends approximately between its two points of articulation 8 and 9. As will be seen later, this cutaway portion 15 enables the upper 7 to tilt very far back in contrast to the known uppers of this type, whose lower front edge very quickly abuts against the lower part of the boot. In the closed position of the boot, as shown in FIG. 1, this cutaway portion 15 is covered by a stirrup-shaped shroud 16 which is articulated on the lower part 1 of the boot, on either side of the latter, at two opposite points 17 and 18 situated below the upper 7, by means of rivets, like the upper 7. This shroud 16 is connected to the upper 7 by a rigid linking member 19 articulated at its ends on each of the parts 7 and 16. This linking member 19 consists of a metal rod having two threaded parts, 20 and 21, threaded in opposite directions, which extend on either side of a knurled extension adjuster 22 and screw into two cylinders 23 and 24 articulated, respectively, on the upper 7 and on the shroud 16. By means of the knurled extension adjuster 22, it is hence possible to modify the length of the linking member 19 and consequently the rake of the upper 7 relative to that of the shroud 16. The shroud 16 has, in addition, a locking member consisting of a rocker 25, articulated ina cutaway portion of the shroud 16 about an axis 26, the end of the lower arm 27 of this rocker abutting against a stop consisting of a seating 28 formed on the lower part of the boot, thereby preventing the shroud 16 from tilting backwards, that is to say maintaining the upper 7 in the forward position for skiing. The rocker 25 is maintained in this position by a spring 29 (FIG. 3) working in compression between the upper arm of the rocker 25 and the bottom of a housing formed in the shroud 16. The rocker 25 has a recess which is visible in FIG. 3, for actuation with a ski stick.

When the skier wishes to relax or walk, it is only necessary for him to unlock the shroud 16 by pressing on the rocker 25, which enables him to straighten his leg. The upper 7, thereby released, can pivot about its articulation. On the other hand, as soon as the user resumes the forward position for skiing, the shroud 16 and the upper 7 lock automatically as soon as the lower edge of the rocker 25 passes over the seating 28.

When the boot is taken off, after the buckles 10 and 11 are unhooked, the upper 7 can tilt back to an ample extent with the shroud 16, the latter being capable of tilting as far as the sole as a result of the position of its points of articulation 17 and 18, which are situated well below the points of articulation of the upper 7. It should be emphasised that the articulation of the shroud 16, which articulation is not anatomical in design, has no influence on the movement of the upper 7 which is, in contrast, matched to the anatomy of the foot.

The cords 5 and 6, which serve to clamp the foot, are led through passages in the sole and are connected to the tilting shroud 16, on whose seatings there bear knurled nuts 30 and 31, enabling the active length of the cords 5 and 6 to be adjusted. Thus, the foot is automatically clamped when the skier bends his leg forwards and when the tilting shroud 16 locks on the lower part of the shoe. Conversely, when the boot is opened (FIG. 2), the tension in the cords 5 and 6 is largely released, this slackening being equal to the height of tilting of the shroud 16.

Figure 4:
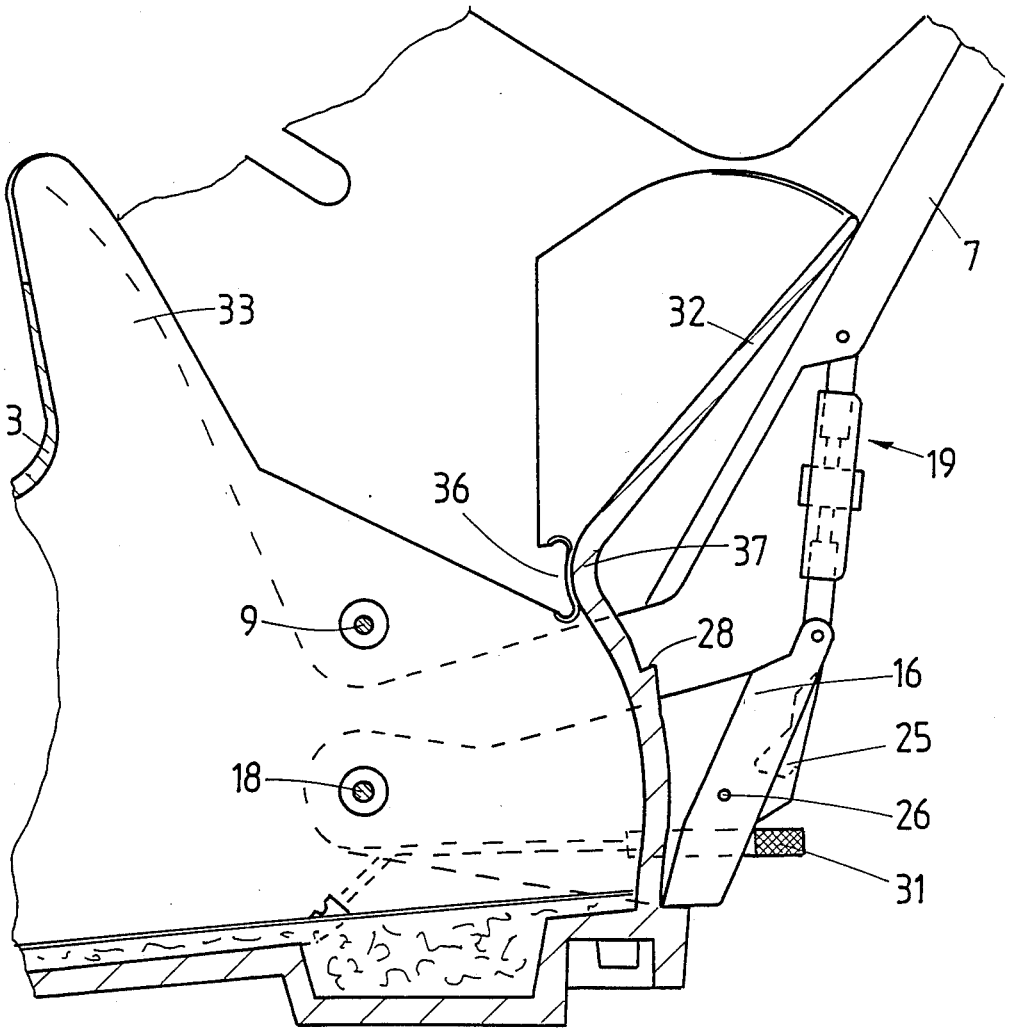
FIG. 4 shows, in section, the same boot in the open position, upper and shroud tilted back.

As has already been mentioned above, the lower part 1 of the boot has a half-upper whose rear part 32 is separated from the fron part 33 by two lateral cutaway portions 34 which extend obliquely in the rear part 32 in the form of two opposite oblique slits 35, each of which opens into two oblong slots 36 extending in parallel along the back of the boot. In the area 37 situated at the height of the slots 36, the back of the boot consequently has some degree of flexibility, enabling the rear part 36 of the half-upper to flex backwards, as shown in FIG. 4, when the boot is in the open position. This tilting can take place either through the pressure of the ankle, or through being drawn by the upper 7. In this case, a sliding link will be provided between the upper 7 and the part 32.

Figure 2:
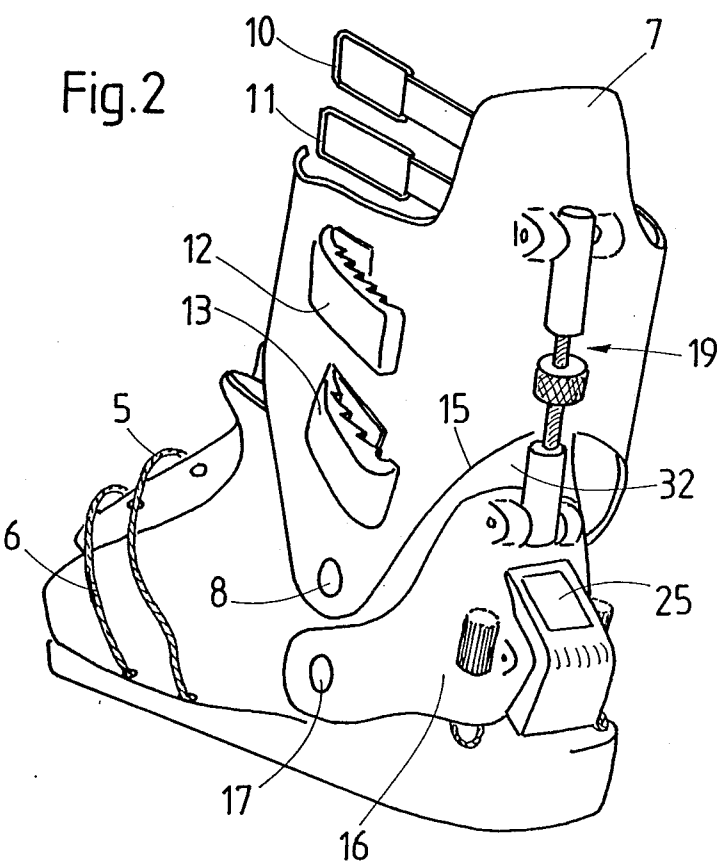
FIG. 2 is a perspective view of the same boot in the open position, upper and shroud tilted back.
Figure 3:
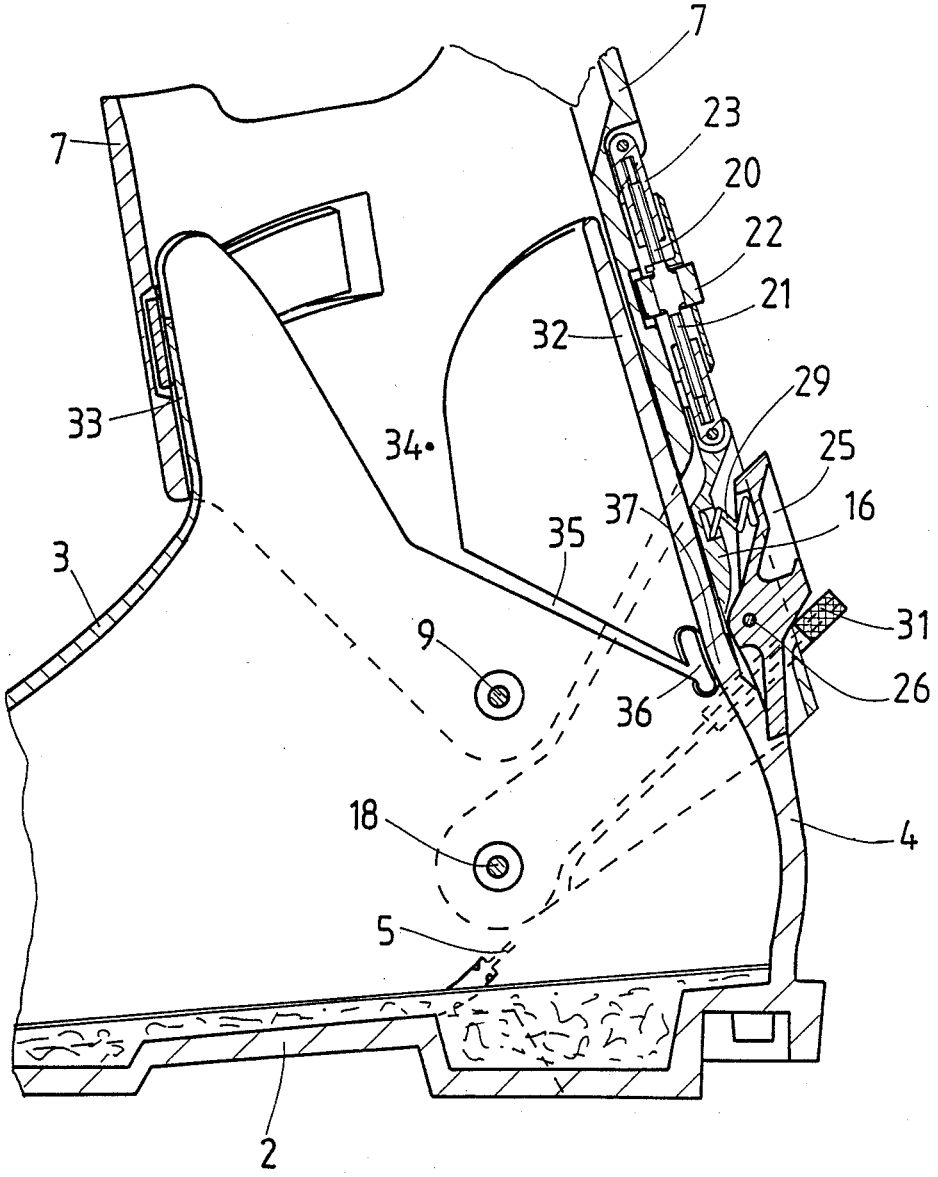
FIG. 3 is a vertical sectional view of the boot in the closed position and shroud locked.

In FIGS. 3 and 4, the passing of the cords 5 and 6 at the back of the shoe is carried out slightly differently from that shown in FIGS. 1 and 2; the cords no longer extend vertically from the tilting shroud 16, but obliquely, which reduces the length of slackening of the cords but also greatly reduces the curvature of the cord at the point where it changes direction, and consequently the friction.

It emerges especially clearly from FIG. 4 that the boot can be opened wide for putting on and taking off. Despite the cutaway portion 15 of the upper, snow-proofing of the boot is ensured by the half-upper 32, and the tilting shroud 16 which not only covers the cutaway portion 15 but also the slits 35 in their lower part.

The means according to the invention are naturally also applicable to a boot having a rigid lower shell, comprising means of diagonal tightening of the heel which comprise a pressure-distributing member situated in the region of the instep, between the shell and the inner boot. It is clearly understood that the cutaway upper can be by itself, without the tilting shroud.

Figure 5:
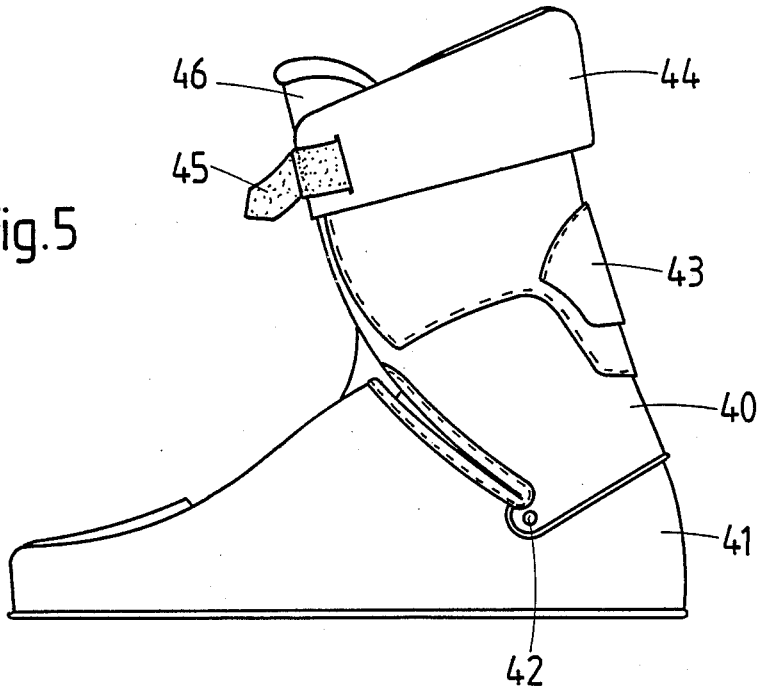
FIG. 5 shows the inner boot in closed position.
Figure 6:
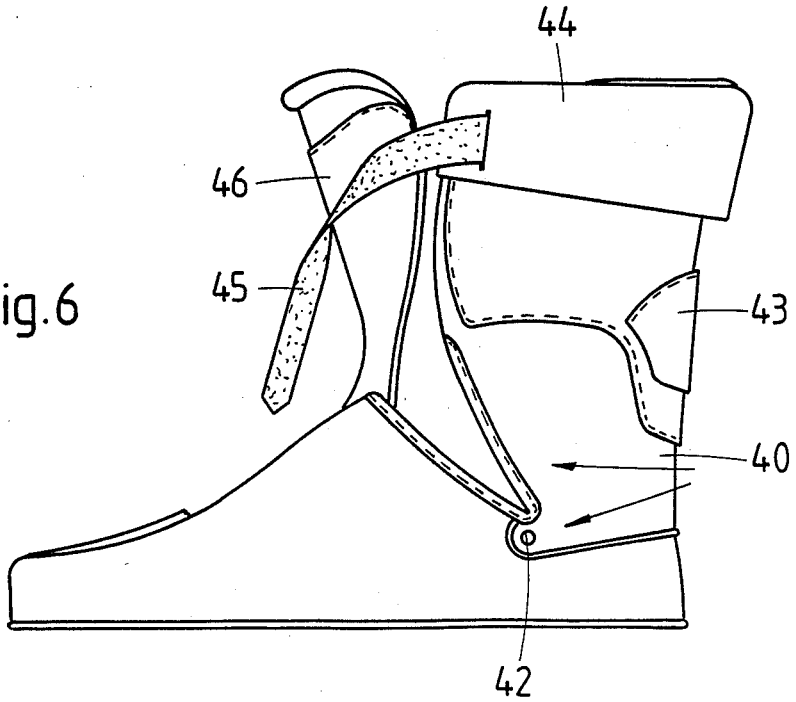
FIG. 6 shows the same boot in open position.

The inner boot 14 is shown by itself in FIGS. 5 and 6. It is of the type described in U.S. Pat. Nos. 3,977,098 and 4,523,392, with modifications specific to its use in a boot as described above. It incorporates an upper part 40 articulated on a lower part 41 about an axis 42. This part 40 is equipped with a pocket 43 into which the part 32 of the boot is introduced, and the upper edge of the part 40 is equipped with a flexible part 44 which folds over the upper edge of the upper 7, in such a way that the inner boot 14 is firmly attached to the upper 7 when the latter is opened. The part 44 is equipped, in addition, with a fastening strap 45 having a Velcro type fastener. The tongue 46 is fixed in the conventional manner.

I claim:

1. A ski boot comprising a lower part (1), comprising the sole and the vamp and surrounding the heel, a one- or two-part upper (7) articulated on the lower part at two opposite points (8, 9) which coincide at least approximately with the joint of the user's foot, wherein a rear part of the upper has a rounded cutaway portion (15) between its points of articulation of sufficient depth to permit an ample backward tilting of this part, and means for releasably locking the upper in a forward upright position for skiing and for permitting the upper to be tilted backwards when released from the locked position.

2. The boot as claimed in claim 1, in which the lower part of the boot (1) comprises a rear half-upper (32) having two lateral slits (35) which extend on each side of the booth, from the inside to the back of this half-upper so as to permit this rear half-upper to tilt back about the portion of material (37) which extends between the ends of the said lateral slits and forms a hinge.

3. The boot as claimed in claim 2, which comprises an inner boot comprising an upper part articulated on a lower part, this upper part being equipped with a pocket into which the said boot rear half-upper is inserted.

4. A ski boot comprising a lower part (1), comprising the sole and the vamp and surrounding the heel, and a one-or two-part upper (7) articulated on the lower part at two opposite points (8, 9) which conicide at least approximately with the joint of the user's foot, wherein the rear part of the upper has a rounded cutaway portion (15) between its points of articulation of sufficient depth to permit an ample backward tilting of this part in which a region uncovered by the said cutaway portion (15) is covered by a stirrup-shaped shroud (16) articulated on the lower part of the boot at two opposite points (17, 18) situated below said opposite points of articulation (8, 9) of the upper, with the result that this shroud (16) can tilt backwards, the rear part of the upper (7) and the tilting shroud (16) being connected to one another by a rigid linking member (19) which extends in a vertical plane and whose ends are articulated, respectively, on the upper and on the tilting shroud.

5. The boot as claimed in claim 4,in which the lower part of the boot (1) comprises a rear half-upper (32) having two lateral slits (35) which extend on each side of the boot, from the inside to the back of this half-upper, so as to permit this rear half-upper to tilt back about the portion of material (37) which extends between the ends of the said lateral slits and forms a hinge.

6. The boot as claimed in claim 4, in which the said linking member (19) has means for adjusting its length.

7. The boot as claimed in claim 6, in which the said means for adjusting length consist of a screw-and-nut assembly (20 to 24).

8. The boot as claimed in claim 4, which comprises means for locking (25) the shroud to the lower part of the boot in the forward position of the upper.

9. The boot as claimed in claim 8, in which the said locking means comprise a rocker (25) pivoted about an axis in a slot in the shroud and whose lower end abuts against a stop (28) formed on the lower part of the boot.

10. The boot as claimed in claim 4, further comprising cords for clamping the front part of the boot, wherein these cords (5, 6) are attached to the tilting shroud (16).

11. The boot as claimed in claim 5, which comprises an inner boot comprising an upper part articulated on a lower part, this upper part being equipped with a pocket into which the said boot rear half-upper is inserted.

12. The boot as claimed in claim 10, in which the said upper part of the inner boot is equipped with a flexible part folded over the upper edge of the said boot upper.

* * * * *